US005527074A

United States Patent [19]

Yeh

[11] Patent Number: 5,527,074

[45] Date of Patent: Jun. 18, 1996

[54] FIRE PROTECTION DOOR LOCK HAVING A HEAT SENSITIVE SAFETY DEVICE

[76] Inventor: Wen Tien Yeh, No. 1-6, Ta Lee Street, Taipei, Taiwan

[21] Appl. No.: 327,139

[22] Filed: Oct. 20, 1994

[51] Int. Cl.[6] ..... E05C 1/02

[52] U.S. Cl. ..... 292/177; 292/DIG. 62; 292/DIG. 66; 292/21; 292/34; 292/92

[58] Field of Search ..... 292/166, 168, 292/174, 332, 333, DIG. 66, 140, DIG. 21, 46

[56] References Cited

U.S. PATENT DOCUMENTS

| | | | |
|---|---|---|---|
| 4,005,886 | 2/1977 | Lirette | 292/DIG. 21 |
| 4,099,292 | 7/1978 | McCabe | 292/DIG. 66 |
| 4,099,753 | 7/1978 | Gwozdz et al. | 292/DIG. 66 |
| 4,145,900 | 3/1979 | Ohno | 292/DIG. 66 |
| 4,445,717 | 5/1984 | Imhoff | 292/DIG. 66 |

*Primary Examiner*—Steven N. Meyers
*Assistant Examiner*—Tuyet-Phuong Pham
*Attorney, Agent, or Firm*—Hawes & Fischer

[57] ABSTRACT

Disclosed is a door lock for locking a double-swinging type fire protection door. The door lock has a safety device controlled by a melting heat sensitive element to lock the spring bolt of the lock bolt in the locked position when the ambient temperature is sharply increased due to a fire.

9 Claims, 4 Drawing Sheets

FIRE PROTECTION DOOR LOCK HAVING A HEAT SENSITIVE SAFETY DEVICE

BACKGROUND OF THE INVENTION

1. Field of the Invention

The present invention relates to door lock devices and more particularly to a safety device of a door lock for locking a double-swinging type fire protection door.

2. Background Art

FIGS. 1 and 2 of the drawings show a door lock for locking a double-swinging type fire protection door according to the prior art. The door lock includes a sliding rod 6' having one end coupled to a lock bolt 61' and an opposite end connected to a spring 60'. An actuating rod 5' which is surrounded by a coil spring 50' is coupled at one end thereof to the sliding rod 6' by a link 4' and connected at the opposite end to a cam 9'. A latch bolt 8' extends out of the casing of the door lock and cooperates with the cam 9'. When the double-swinging door is closed, the latch bolt 8' is pushed inside the casing of the door lock causing the cam 9' to move the sliding rod 6' upwardly via the actuating rod 5' and the link 4'. Accordingly, the lock bolt 61' is extended out of the casing of the door lock with the upward movement of the sliding rod 6' and inserted into the usual hole on the frame of the door to lock the door in the locked position.

Although this conventional door lock is functional under normal conditions, it has several drawbacks. First, the aforesaid door lock is complicated in structure and in assembly process, and, consequently, its manufacturing cost is high. Another drawback to this door lock is that the springs (50' and 60') may be subject to deformation and damage under heat during a fire thereby preventing the locking mechanism from functioning in a normal manner to insure that the lock bolt 61' can be moved upwards to the locked position of FIG. 2. Consequently, the door may remain unlocked and fail to prevent the spread of the fire.

SUMMARY OF THE INVENTION

The present invention overcomes the aforementioned problems with the prior art door lock of FIGS. 1 and 2. It is therefore one object of the present invention to provide a door lock which is structurally simple and inexpensive to manufacture. It is another object of the present invention to provide a door lock which is able to securely lock a fire protection door and thereby prevent the spread of fire when a fire takes place. It is still another object of the present invention to provide a door lock which can be unlocked to open the fire protection door when the door is hit from the outside by a certain pressure.

According to one aspect of the present invention, the door lock comprises a casing mounted on one of the door panels of a double-swinging door and having a faceplate longitudinally disposed at one side thereof, a substantially U-shaped supporting frame disposed inside the casing in the middle, and a sliding tube inserted in a hole through two opposite side walls of the supporting frame. A movable rod has a rear end connected to the front end of the sliding tube and a front end coupled with a lock bolt. A front locating frame is mounted on the casing and fastened to one side of the door panel to guide the movement of the lock bolt out of the casing and into receipt by a hole of the door frame. An L-shaped plate is disposed inside a rear locating frame on the casing and fastened to the sliding tube. A first spring is mounted around the movable rod between the sliding tube and the lock bolt. A second spring is mounted around the sliding tube between the supporting frame and the L-shaped plate. A latch bolt is received in the rear locating frame and moved to project out of the faceplate of the casing. An actuating plate is pivotally mounted around a round rod inside the rear locating frame and moved by the L-shaped plate to push the latch bolt out of the casing in locking the other door panel of the double-swinging door.

According to another aspect of the present invention, the supporting frame has a top extension plate spaced above the movable rod and a safety device fastened to the top extension plate. The safety device has a front end fixed in place by a screw and a slotted, spring biased rear end retained by a heat sensitive element. The slotted rear end of the safety device is released from the heat sensitive element to stop the sliding rod from moving backwards when the ambient temperature surpasses a critical range. Therefore, the lock bolt is locked in the locking position when there is a fire to prevent the spread of the fire past the door.

DETAILED DESCRIPTION

Figure 1:
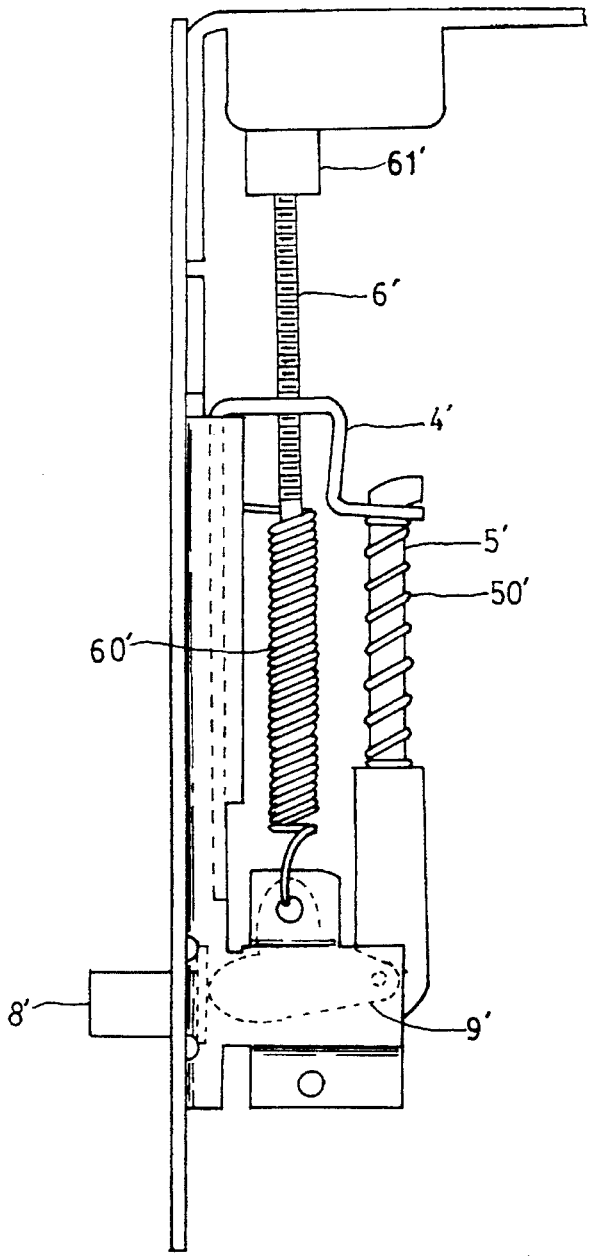
FIG. 1 PRIOR ART
FIG. 1 shows the internal structure of a door lock according to the prior art with a lock bolt located inwardly of a casing.
Figure 2:
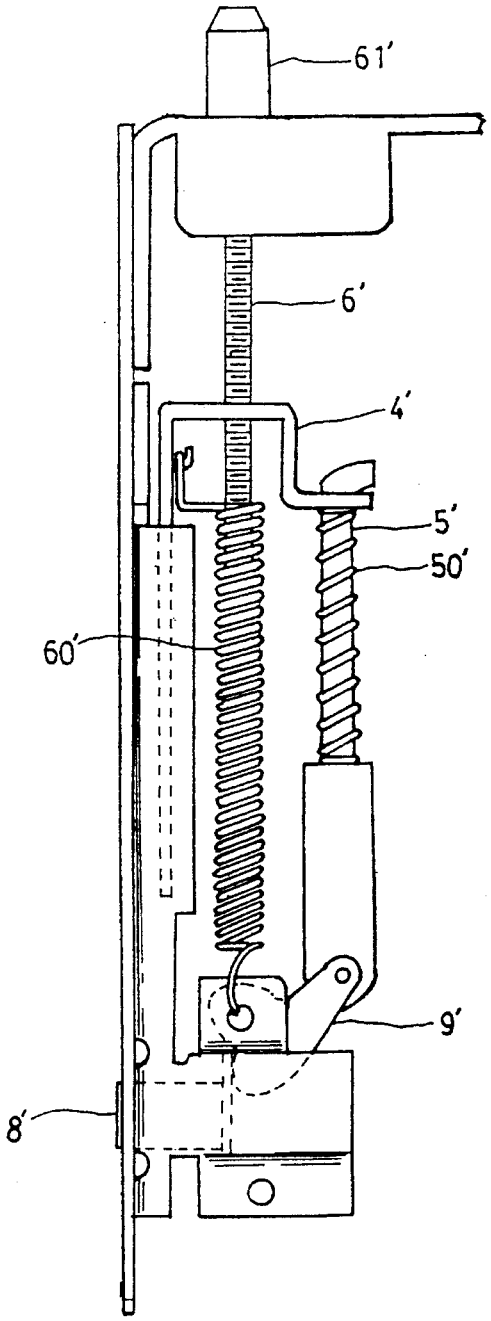
FIG. 2 PRIOR ART
FIG. 2 is similar to FIG. 1 but showing the lock bolt projecting out of the casing.
Figure 3:
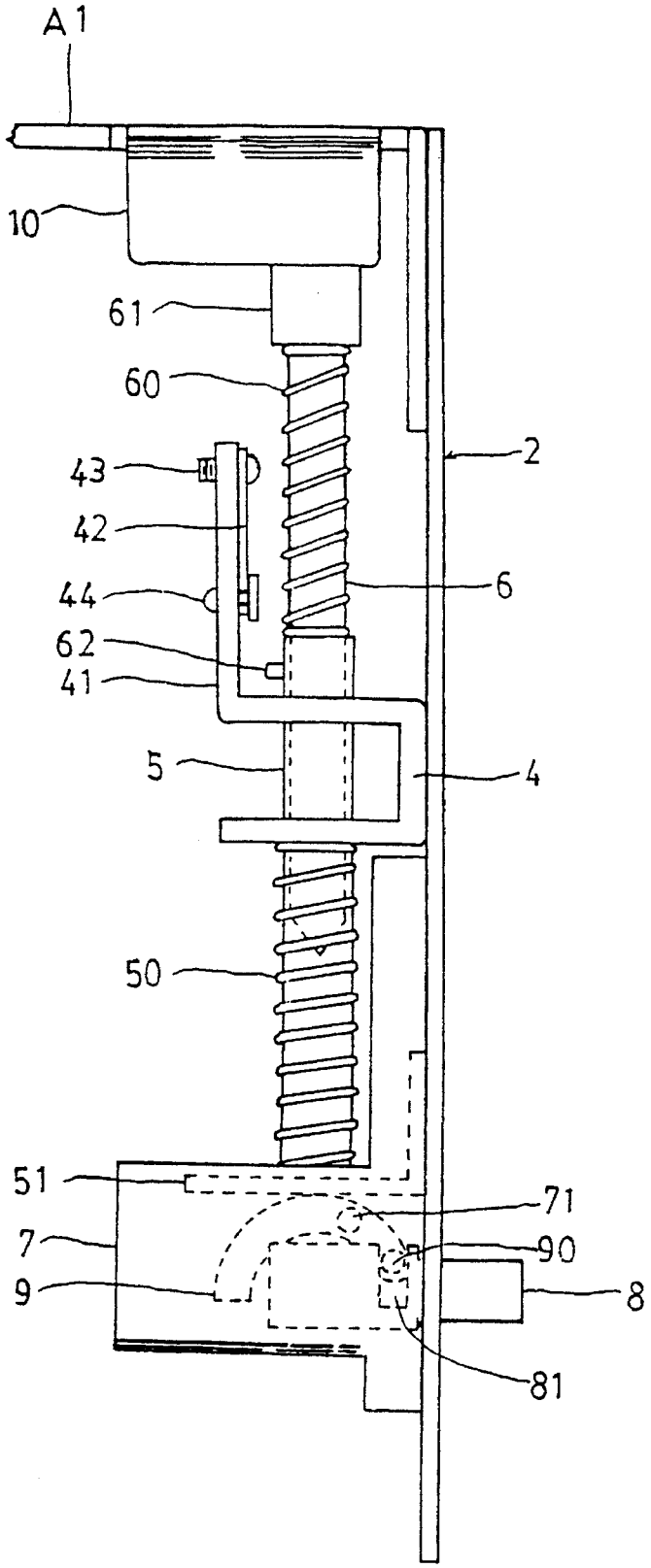
FIG. 3 shows the internal structure of a fire protection door lock according to the present invention with a lock bolt located inwardly of a casing.
Figure 8:
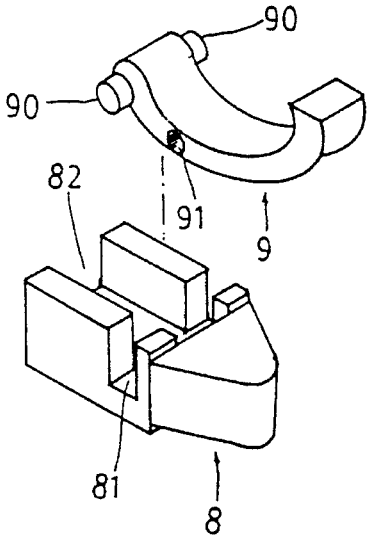
FIG. 8 is an exploded view of an arched actuating plate and a latch bolt for the fire protection door lock shown in FIG. 3.

Referring initially to FIGS. 3 and 8 of the drawings, a lock in accordance with one aspect of the present invention includes a casing 2 mounted on one door panel of a double-swinging door and having a faceplate (not shown) longitudinally disposed at one side thereof. A substantially U-shaped supporting frame 4 is disposed inside the casing 2 in the middle, and a sliding tube 5 is inserted in holes (not shown) through two opposite side walls of the supporting frame 4. A movable rod 6 has one end thereof fastened to one end of the sliding tube 5 and an opposite end coupled with a lock bolt 61. A front locating frame 10 is affixed to the casing 2 and fastened to on side A1 of the door panel to guide the movement of the lock bolt 61. An L-shaped plate 51 is disposed inside a rear locating frame 7 on the casing 2 and fastened to the opposite end of the sliding tube 5. A first coil spring 60 is mounted around the movable rod 6 between the sliding tube 5 and the lock bolt 61. A second coil spring 50 is mounted around the sliding tube 5 between the supporting frame 4 and the L-shaped plate 51.

A latch bolt 8 (best shown in FIG. 8) is received in the rear locating frame 7 and moved to project out of the faceplate of the casing 2. An arched actuating plate 9 has two opposite pivot pins 90 at a first end to be pivotally retained in a transverse groove 81 through the latch bolt 8. A transverse through hole 91 in the middle of actuating plate 9 receives a round rod 71 inside the rear locating frame 7. The latch bolt 8 has a longitudinal groove 82 linked to the transverse groove 81 for receiving the opposite end of the arched actuating plate 9 when the arched actuating plate 9 is rotated backwards.

Figure 4:
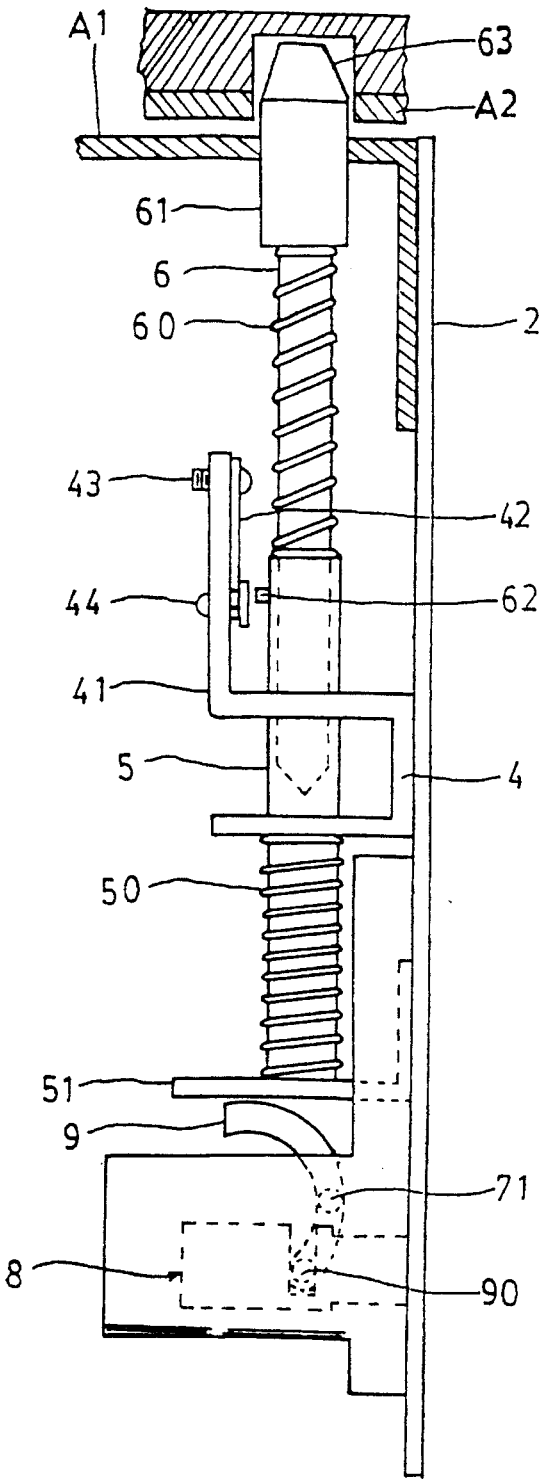
FIG. 4 is similar to FIG. 3 but showing the lock bolt projecting out of the casing and inserted into a hole on the door frame.
Figure 5:
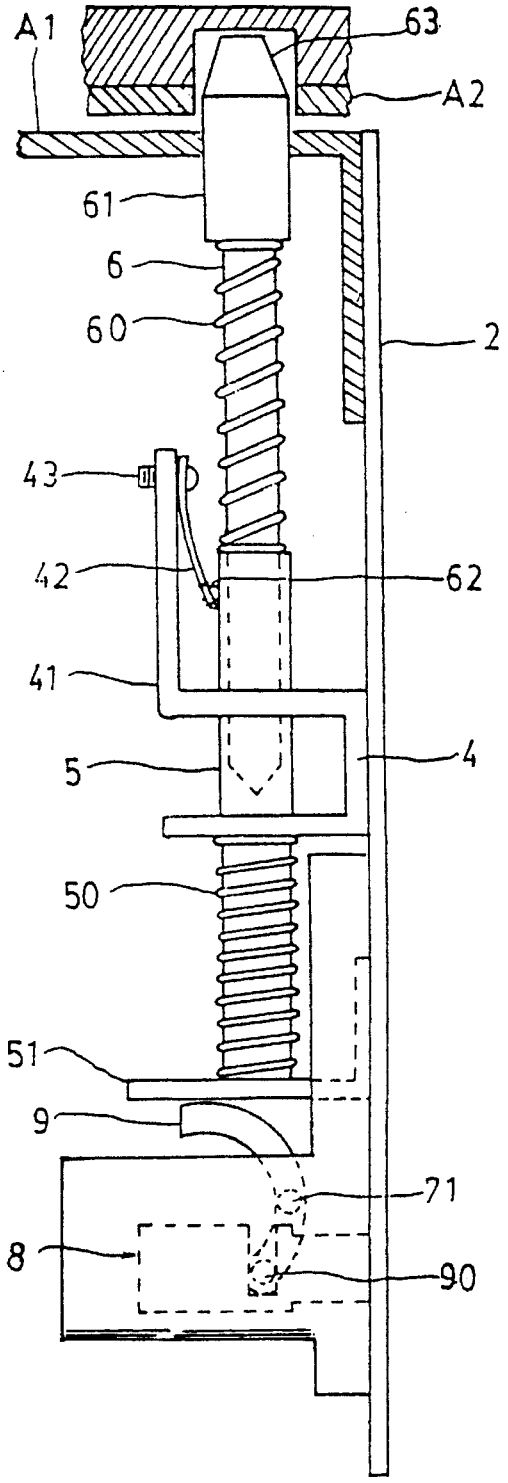
FIG. 5 is similar to FIG. 4 but showing a sliding rod retained in the locking position by a safety device.
Figure 6:
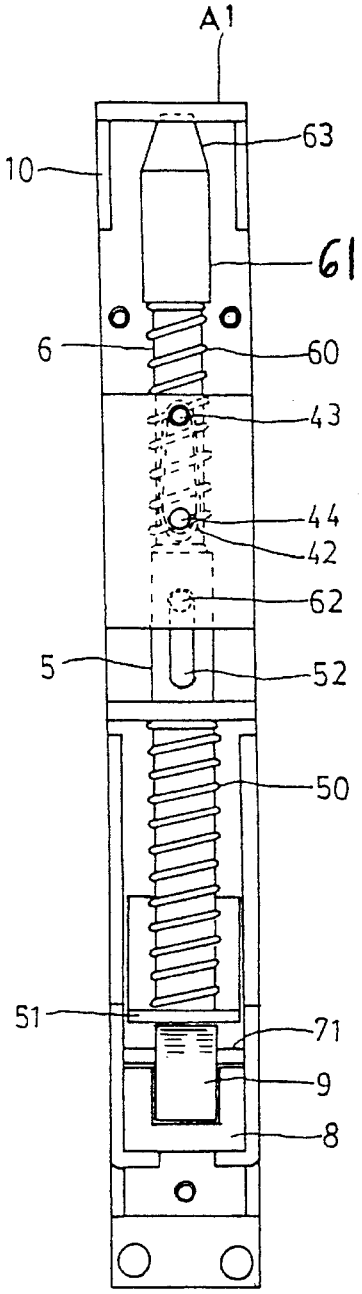
FIG. 6 is a top plan view of the fire protection door lock shown in FIG. 3.
Figure 7:
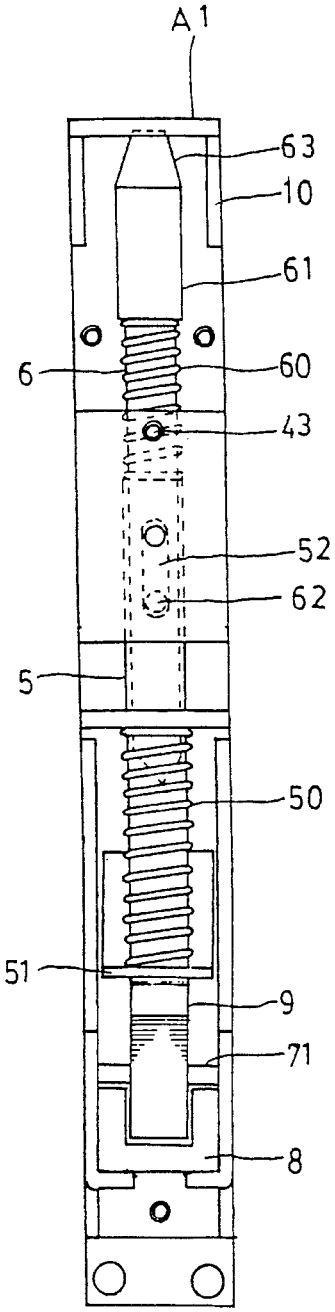
FIG. 7 is similar to FIG. 6 but showing the lock bolt retracted in response to an external hitting force.

When the lock is fastened to the first door panel of a double-swinging door, the latch bolt 8 projects out of the faceplate of the casing 2 (see FIG. 3). When the second door panel of the double-swinging door is closed, the latch bolt 8 is pushed back inside the casing 2 causing the arched actuating plate 9 to rotate forwardly on the round rod 71 (see FIG. 4). When the arched actuating plate 9 is rotated forwardly, the L-shaped plate 51 is squeezed to move the sliding tube 5 and the movable rod 6 causing the lock bolt 61 to project out of the front locating frame 10 to be inserted into a hole (see FIG. 4) on the door frame A2.

When the second door panel is opened, the latch bolt 8 is released from the second door panel permitting the sliding tube 5 to be moved to its former position by the second spring 50. At the same time that the sliding tube 5 is moved back to its former position, the lock bolt 61 is pulled back inside the front locating frame 10. Moreover, the L-shaped plate 51 exerts a pushing force on the pivot pins 90 causing the arched actuating plate 9 to rotate backwards. Therefore, the latch bolt 8 is once again forced outwardly from the faceplate of the casing 2.

Referring concurrently to FIGS. 3–7, the supporting frame 4 comprises a coextensive extension plate 41 longitudinally disposed at the top of frame 4 in parallel alignment with the movable rod 6. According to another aspect of the present invention, a connecting means (i.e. a spring-like safety device 42) is fastened to the bottom of the extension plate 41. The safety device 42 has a front end affixed to the extension plate 41 by a screw 43 and a rear end slotted and connected to the extension plate 41 by a heat sensitive element 44 (see FIG. 4). The aforesaid sliding tube 5 has an oblong slot 52 on the peripheral wall thereof in the longitudinal direction (see FIG. 6). The movable rod 6 has a connecting means (i.e. a round pin 62) projecting therefrom and inserted through the oblong slot 52 (see FIG. 6).

When the ambient temperature increases sharply (due to a fire or any unexpected reason) and surpasses the melting point of the heat sensitive element 44, the heat sensitive element 44 is immediately melted, causing the slotted rear end of the spring-like safety device 42 to be released from the extension plate 41 and then hooked around the round pin 62 (see FIG. 5), whereby the lock bolt 61 is prohibited from moving backwards. As indicated, when the heat sensitive element 44 is melted during a fire, the slotted rear end of the safety device 42 is released from the extension plate 41 to engage the round pin 62 causing the spring bolt 61 to be retained in the locking position. Therefore, the flame of the fire is temporarily stopped from escaping out of the double-swinging door.

When firemen arrive, they can hit the double-swinging door to damage the safety device 42 causing the safety device 42 to be disengaged from the round pin 62 of the movable rod 6, whereby the double-swinging door can be opened. Because the lock bolt 61 has a front sloping surface 63, it can be forced to retract and to move back inside the front locating fame 10 when the double-swinging door is hit by force (see FIG. 7).

While the preferred embodiment of the present invention has been shown and described, it will be understood that various modifications and changes could be made without departing from the spirit and scope of the invention.

I claim:

1. A door lock mounted in a first door of a swinging double door assembly including the first door and a second door, said door lock having a lock bolt adapted for movement in a first direction outwardly from the first door for receipt by a hole in an adjacent door frame so that the first door can be closed and locked and in a second direction out of the hole and inwardly of the first door so that the first door can be unlocked and opened, said door lock comprising:

a sliding tube interconnected at a first end thereof with the lock bolt;

means to impart reciprocal movement in said first and second directions to said sliding tube for correspondingly causing the lock bolt to move in said first and second directions relative to the first door;

a stationary supporting frame having a body to support said sliding tube for said reciprocal movement therethrough, said supporting frame also having an extension arm extending from said body in spaced alignment with said sliding tube;

first and second connection means;

said first connection means projecting outwardly from said sliding tube and movable therewith;

said second connection means having first and second ends, said first end fixedly connected to said extension arm of said supporting frame;

heat sensitive means to releasably attach said second end of said second connection means to said extension arm, said heat sensitive means responsive to a particular temperature to release said second end of said second connection means from said extension arm for movement into mating engagement with said first connection means projecting from said sliding tube when the lock bolt is moved in said first direction into receipt by the hole in the door frame so as to couple said sliding tube to said supporting frame and thereby prevent the movements of said sliding tube in said second direction and the lock bolt out of the hole in the door frame;

a movable rod, one end of said movable rod connected to the lock bolt and the opposite end of said movable rod received in and movable through said sliding tube; and a spring surrounding said movable rod and extending between the lock bolt and said sliding tube.

2. The door lock recited in claim 1, wherein said first connection means projecting outwardly from said sliding tube is a pin.

3. The door lock recited in claim 2, wherein the second end of said second connection means has a slot formed therein, said slot receiving the pin of said first connection means to mate said first and second connection means together and thereby couple said sliding tube to said supporting frame.

4. The door lock recited in claim 1, wherein said heat sensitive means is adapted to melt in response to said particular temperature to release the second end of said second connection means from the extension arm of said supporting frame.

5. The door lock recited in claim 1, wherein said sliding tube has a slot formed therein, said first connection means projecting outwardly through said slot from said movable rod.

6. The door lock recited in claim 1, wherein said means to impart reciprocal movement to said sliding tube includes a latch bolt movable outwardly from and retractable inwardly of the first door for receipt by and withdrawal from the second door of said double door assembly and an arched actuating plate pivotally coupled to said latch bolt and rotatable from a first position at which to exert an axial pushing force on said sliding tube to urge said sliding tube to move in said first direction and the lock bolt to be received in the hole in the door frame and at which to urge said latch bolt to move outwardly from the first door, to a second position at which said axial pushing force is terminated, whereby said sliding tube moves in said second direction and the lock bolt is removed from the hole in said door frame and at which said latch bolt is retracted inwardly of the first door.

7. The door lock recited in claim 6, wherein said latch bolt has a transverse groove and said arched actuating plate has at least one pivot pin projecting therefrom, said pivot pin received in said transverse groove in order that said actuating plate is pivotally coupled to said latch bolt.

8. The door lock recited in claim 6, further comprising a flat plate connected to the opposite end of said sliding tube and communicating with said arched actuating plate so that a rotation of said actuating plate to said first position exerts said axial pushing force on said sliding tube by way of said flat plate.

9. The door lock recited in claim 8, further comprising spring means surrounding said sliding tube between said supporting frame and said flat plate.

* * * * *